United States Patent [19]

Tooka

[11] Patent Number: 4,537,018

[45] Date of Patent: Aug. 27, 1985

[54] APPARATUS FOR SLIVER CAN CONTROLLING IN A SPINNING MILL

[75] Inventor: Takuzo Tooka, Toyoake, Japan

[73] Assignee: Kabushiki Kaisha Toyoda Jidoshokki Seisakusho, Kariya, Japan

[21] Appl. No.: 543,914

[22] Filed: Oct. 20, 1983

[30] Foreign Application Priority Data

Oct. 23, 1982 [JP] Japan ..... 57-186544

[51] Int. Cl.[3] ..... D01H 9/18; D01H 13/24; D01H 13/32

[52] U.S. Cl. ..... 57/90; 57/80; 57/81; 57/263; 57/264; 57/266; 57/276; 57/281; 242/35.5 R

[58] Field of Search ..... 57/266, 261, 276, 263, 57/281, 80, 81, 90, 264; 242/18 R, 35.5 R, 35.5 A, 35.6 R, 36, 37 R, 37 A

[56] References Cited

U.S. PATENT DOCUMENTS 3,884,026 5/1975 Yoshizawa et al. ..... 57/281

4,012,893 3/1977 Weber ..... 57/281

*Primary Examiner*—John Petrakes

*Attorney, Agent, or Firm*—Brooks, Haidt, Haffner & Delahunty

[57] ABSTRACT

An apparatus for sliver can controlling in a spinning mill having a plurality of spinning machines each comprising a plurality of spinning stations. The apparatus includes various lines of sliver can transporting tracks through which a full sliver can may be brought to a position adjacent to any of the spinning stations, as required. Sliver consumption quantities at the respective stations are computed by a control circuit as a central processing unit. When the sliver consumption at any one of the spinning stations reaches a predetermined quantity at which its sliver can is nearly empty, the control circuit operates to energize a warning means and means for indicating the number designating such spinning station calling for sliver can replacement. Simultaneously, the control circuit operates to drive and actuate the transporting means and guide means incorporated in the transporting tracks in such a way that a route is established through which the sliver can is transferred up to a position adjacent to the spinning station at issue.

6 Claims, 7 Drawing Figures

APPARATUS FOR SLIVER CAN CONTROLLING IN A SPINNING MILL

BACKGROUND OF THE INVENTION

The present invention relates to an apparatus for sliver can controlling in a spinning mill having a plurality of spinning machines each comprising a plurality of spinning stations. More specifically, it relates to an apparatus for controlling the transportation of a full sliver can to a specific destination adjacent to a spinning station in response to a signal transmitted therefrom signaling the need for replacement of its nearly empty sliver can with the full one.

According to a conventional procedure in a spinning mill having a plurality of spinning machines each of which comprises a plurality of individual working or spinning stations, e.g. of an open-end type, each having a sliver can or container for holding therein a strand of sliver to be fed continuously to its associated spinning unit, it has been customary practice that a workman walks around each of the spinning machines to check visually for the remaining quantity of sliver in each of the sliver cans and, when any can is found which is about to be emptied and therefore needs be replaced with a full one, he walks to where full sliver cans are stored to bring one of them back to the spinning station is question.

Sliver can replacing thus includes visual checking for the remaining quantities at the respective spinning stations and the bringing of a full sliver can to each of the spinning stations as required. This causes a lot of trouble for production personnel. For female workers, in particular, the operation is extremely laborious. This conventional procedure is further disadvantageous not only with regard to the productivity of the spinning machines in that a great deal of non-productive time may be consumed unless empty cans are observed in a timely manner and full cans are brought to their destinations in a systematic manner, but also with regard to labor saving in that more labor is required in a spinning mill having more installations of spinning machines.

An object of the present invention is therefore to remove the above disadvantages and drawbacks by providing an apparatus for sliver can controlling adapted for use with a spinning machine, the use of which apparatus reduces the troubles associated with sliver can replacement and permits a more rational system of sliver can control.

The above and other objects and advantages of the present invention will become more readily apparent to those skilled in the art from the following detailed description of a preferred embodiment of the invention as applied to an open-end spinning machine, taken in conjunction with the accompanying drawings, wherein:

DETAILED DESCRIPTION OF PREFERRED EMBODIMENT

The following will provide detailed description of a preferred embodiment of sliver can controlling apparatus according to the invention, as applied to an open-end type spinning machine.

Figure 1:
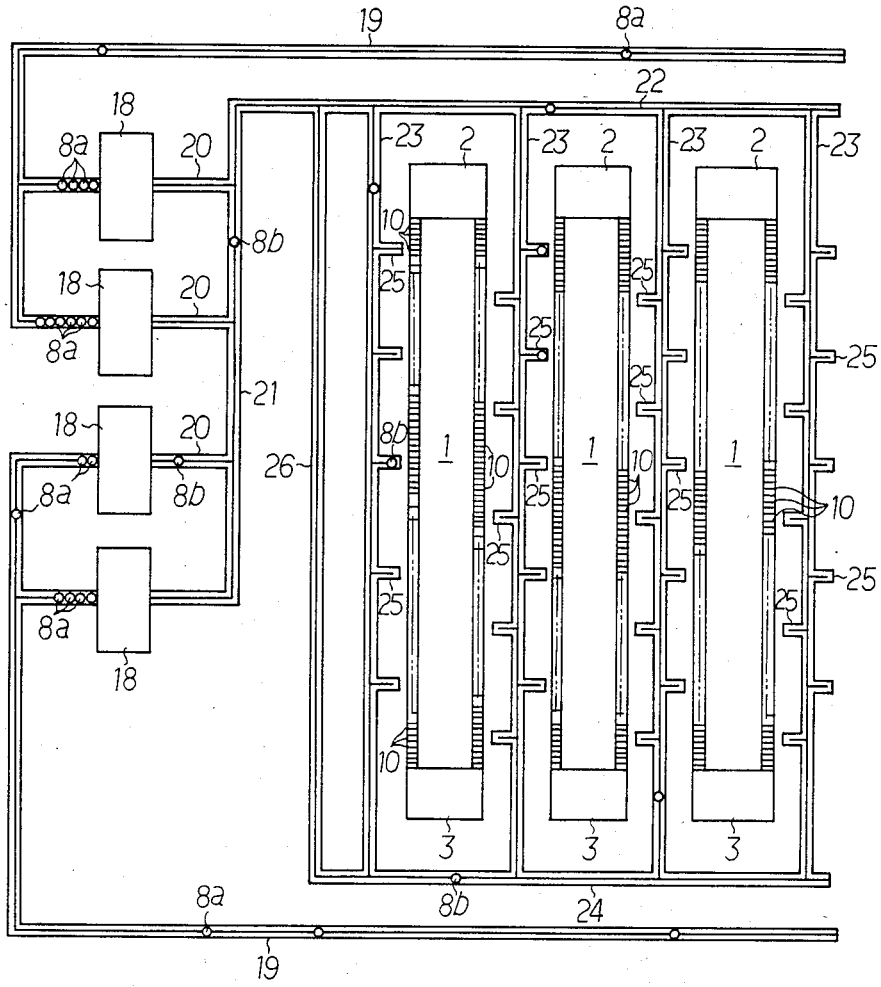
FIG. 1 is a schematic diagram in plan view showing a layout of open-end spinning machines and various lines of sliver can transporting track in a preferred embodiment of the invention.

Reference is had firstly to FIG. 1, wherein there are provided a plurality of spinning machines 1, each of which has a plurality of spinning units disposed in a side-by-side arrangement on both sides thereof between its gear end 2 and out end 3, each of said spinning units defining a working or spinning station of the spinning machine 1.

Figure 2:
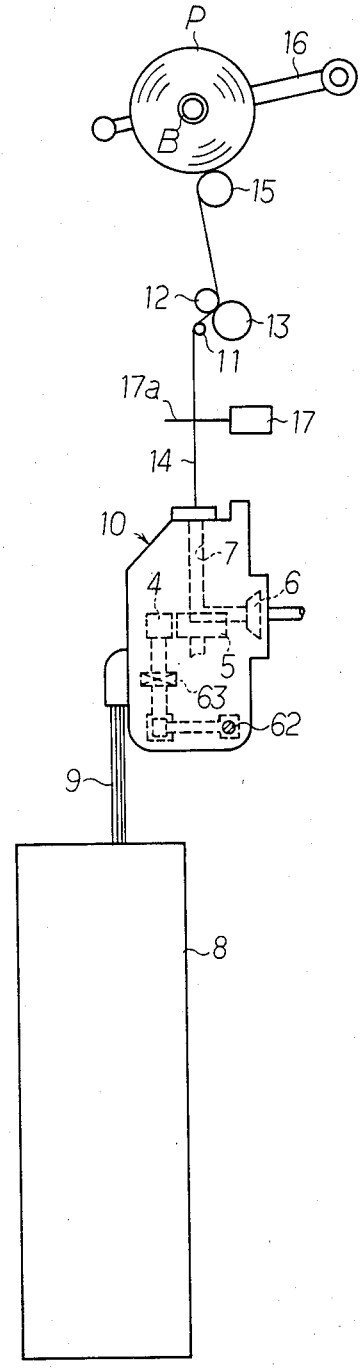
FIG. 2 is a schematic side elevation of a spinning station in an open-end spinning machine.

A spinning station of the open-end spinning machine 1 is exemplified in FIG. 2, wherein it includes a spinning unit 10 having therein a feed roller 4, a combing roller 5, a spinning rotor 6 and a yarn draw-off tube 7, for drawing a sliver 9 from its sliver can 8 disposed therebelow and transforming the same into a strand of twisted spun yarn 14. The spinning station further includes a yarn guide 11, a draw-off roller 13 paired with a pressure roller 12 and a winding drum 15 which is provided common to all the spinning stations on one side of the machine for winding up the spun yarn 14 while distributing the same traversely on a bobbin B to form a yarn package P in the shape of a cone or the like. The bobbin B is supported by a cradle arm 16 which is swingable up and down to move the package P to and away from the rotating winding drum 15.

In addition, each spinning station is equipped with a yarn sensor 17 as a means for detecting abnormal passage of the yarn 14, disposed in the shown embodiment between the spinning unit 10 and yarn guide 11. The yarn sensor 17 has a feeler portion 17*a* which is arranged so as to be kept in engagement with the yarn 14 during the normal spinning and winding operation at the spinning station. When its feeler portion 17*a* is released from engagement with the yarn, e.g., due to a break therein, the sensor 17 is caused to be energized or turned on, thereby emitting a detect signal. In the preferred embodiment hereof, this yarn sensor 17 is desirably made so that its feeler portion 17*a* is disengaged from the yarn to keep said detect signal effective while a full package having a predetermined length or quantity of yarn wound thereon is being doffed and replaced with an empty bobbin by a known doffer (not shown).

Referring back to FIG. 1, four units of drawing frames 18 are installed on the left hand side of the spinning machines 1, where empty sliver cans 8*a* which had returned thereto via return tracks 19 are filled with a predetermined length or quantity of sliver 9 for preparing full sliver cans 8*b*. The cans 8*b* thus filled with strand of new sliver 9 are fed out from the drawing frames 18 through delivery tracks 20, respectively, to a leading track 21. The cans 8*b* are further conveyed to a distributing track 22 which is provided extending along the gear ends 2 of respective spinning machines 1.

Between the distributing tracks 22 and a second distributing track 24 extending along the opposite outer ends 3 of the spinning machines 1 are provided a plurality of supply tracks 23 branched off from said distributing track 22 and extending parallel to the respective spinning machines in such a way that each spinning machine is flanked by two adjacent supply tracks 22. Can takeout tracks 25 are branched off from each of the supply tracks 23 toward the side or sides of the spinning machine or machines 1, spaced at intervals of length corresponding to about ten spinning stations. Between the drawing frames 18 and spinning machines 1 is provided additionally a storage track 26 extending parallel to the supply tracks 23 and connected to the distributing track 22 on one hand and to the second distributing track 24 on the other, for storing temporarily full sliver cans 8*b*.

The construction of such various lines of sliver can transporting tracks 19–26 will be described in the following. Since each of the transporting tracks is configured substantially in the same way, the following description is applicable to all the tracks.

Figure 3:
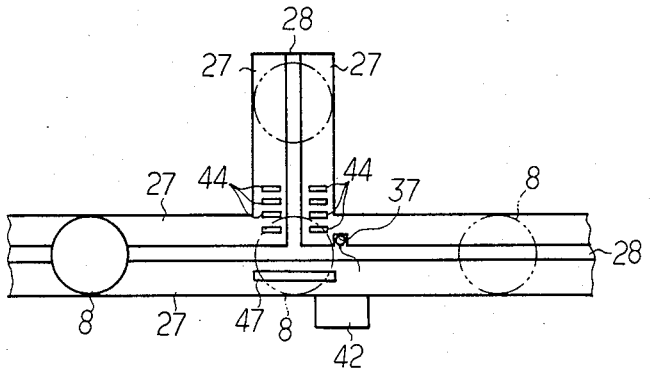
FIG. 3 is a top view showing a branch-off junction of any two lines of sliver can transporting track.
Figure 4:
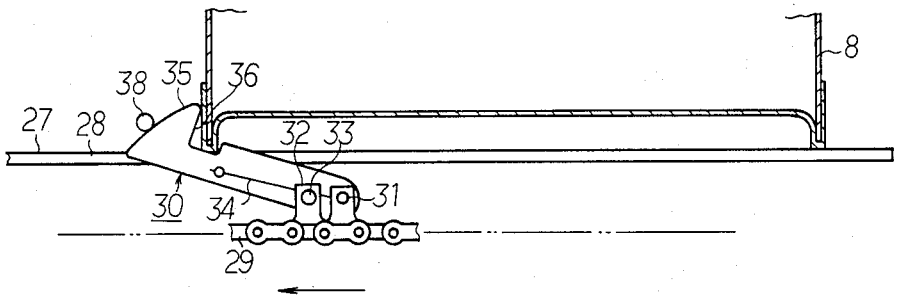
FIG. 4 is a side view showing a sliver can transporting means in its operative position in engagement with a sliver can.

Referring to FIGS. 3 and 4, the transporting track is formed by a pair of laterally spaced-apart sliver can supporting plates 27 having a guide groove 28 formed therebetween along the longitudinal center of the track. In the space below the supporting plate 27 is installed a transporting chain 29 extending along the track and equipped with sliver can transporting hooks 30 at predetermined intervals of length, each of said transporting hooks 30 having an end which may be protruded, as required, out of the space through said guide groove 28 as shown in FIG. 4. The transporting hook 30 is mounted pivotally and is swingable toward and away from the chain 29 about a shaft 31 and urged normally in clockwise direction as viewed in FIG. 4 under the influence of a spring 34 mounted by a pin 33 of a supporting piece 32 projecting from the chain 29. The hook 30 is formed at its free end with a curved tilt portion 35 and at an intermediate portion on the upper side thereof with a recess 36 engageable with the bottom edge of the sliver can 8 when the hook 30 is swung up to protrude its end through said guide groove 28. Therefore, as the chain 29 is driven in a direction depicted by an arrow (FIG. 4), the transporting hook 30 in engagement at its recess 36 with the bottom edge of the sliver can causes the can to slide in the same direction on the supporting plate 27.

A mechanism for leading or guiding a sliver can 8 at a junction from a certain line of transporting track to another line which is branched off therefrom will be now described in the following with reference to FIGS. 3 to 6.

The supporting plate 27 is formed with a cut portion or opening 37 adjacent to a junction, as shown in FIG. 3, for allowing a movable releasing member 38 to protrude through said opening 37 for engagement with the curved tilt portion 35 of the transporting hook 30. As the portion 35 of the advancing hook 30 is engaged with the releasing member 38 in protruded position as shown in FIG. 4, the hook is forced to swing down and, accordingly, its recess 36 disengaged from the bottom edge of the sliver can 8, so that said can is stopped at the junction.

Figure 5:
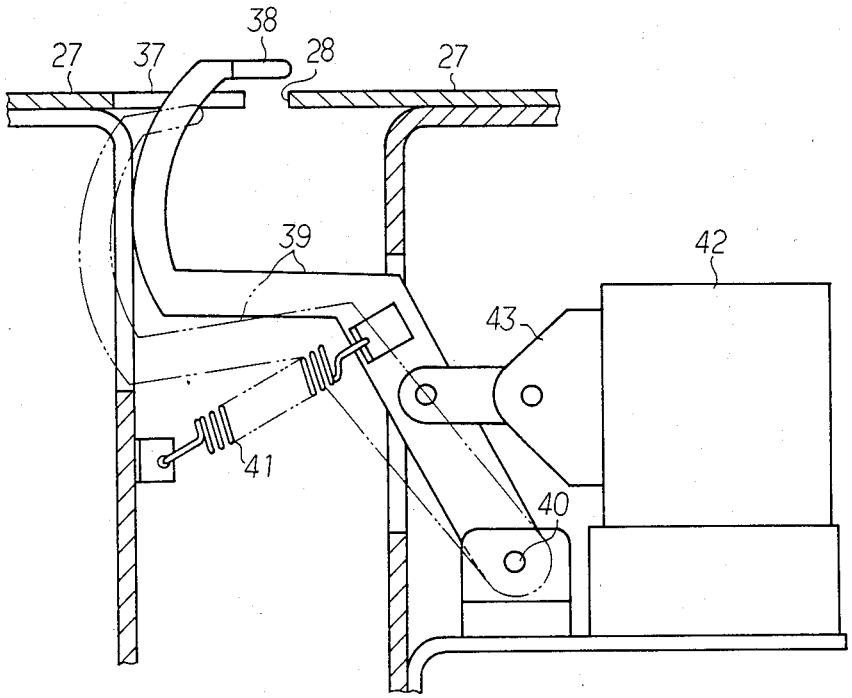
FIG. 5 is an illustrative view shown in a larger scale of a mechanism for releasing the sliver can transporting means of FIG. 4.

As shown in FIG. 5, the releasing member 38 is fixed to the free end of an arm 39 swingable about an axis 40, and moved to its protruded (shown by full line) or retracted (shown by phantom line) position by swinging the arm 39 about its axis 40. A spring 41 is connected between a stationary track frame and the arm 39, while a plunger 43 of an electromagnetically-operated solenoid 42 is connected to said arm. Though the releasing member 38 is normally held in its inoperative position below the supporting plate 27 under the influence of the biasing force of the spring 41, it is moved to its operative position above the plate 27 when the solenoid 42 as an actuator for the swingable arm 39 is energized to retract its plunger 43 thereby pulling the arm against the force exerted by the spring 41. As stated earlier, the releasing member 38 thus held in its operative position may engage with the portion 35 of the approaching transporting hook 30 for disengaging the sliver can 8 from said hook.

Figure 6:
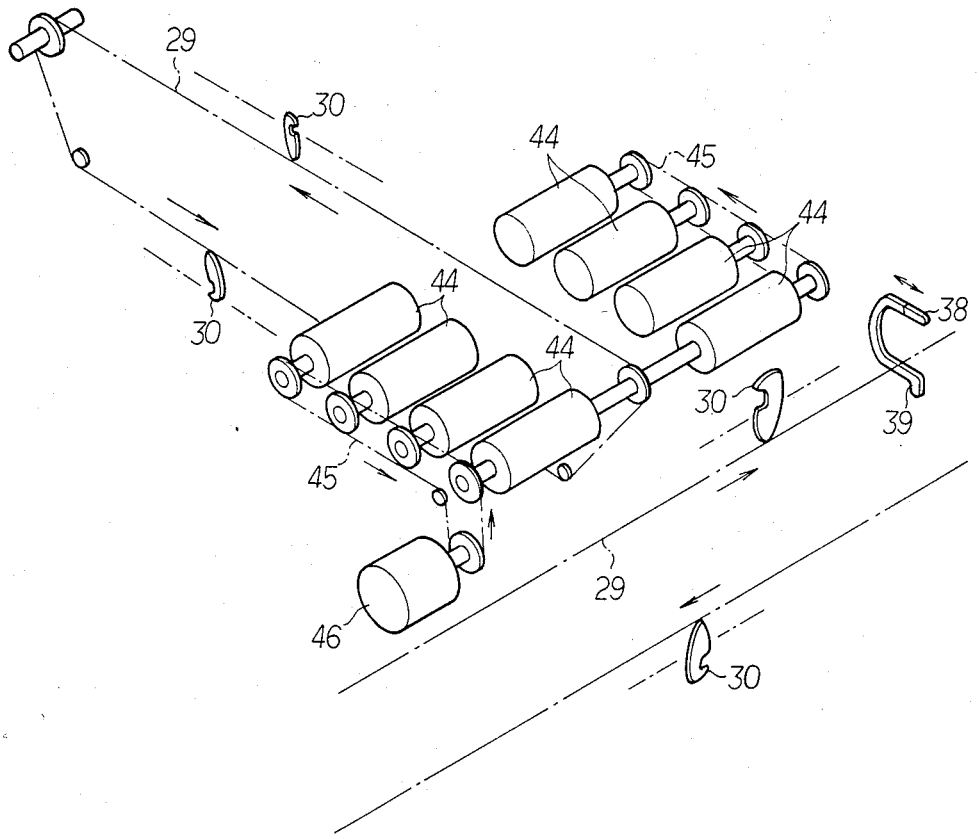
FIG. 6 is a perspective view showing a driving system at a branch-off junction of any two lines of sliver can transporting track.

Referring then to FIGS. 3 and 6, a plurality of rollers 44 are arranged along part of the branched-off track adjacently to the junction and driven by a motor 46 through driving chains 45 in a direction to advance the sliver can 8 along the track. As is apparent from FIG. 6, the motor 46 is used also to drive the transporting chain 29 extending endlessly in the space of the branched-off track so that the hooks 30 attached to the chain 29 may be moved therewith. In this way, a sliver can 8 stopped at a junction of two different lines of transporting track may be led to the branched-off track by rotating its rollers 44 and moved further along the track then by means of a transporting hook 30 moving with the chain 29 of the branched-off track. Depending on the transporting tracks, the motor 46 may be so arranged that it drives the transporting chain 29 directly unlike the arrangement shown in FIG. 6 wherein the chain 29 is driven via a sprocket installed on a shaft carrying the foremost pair of rollers 44. The reference numeral 47 (FIG. 3) designates an independent roller which is rotatable freely.

Figure 7:
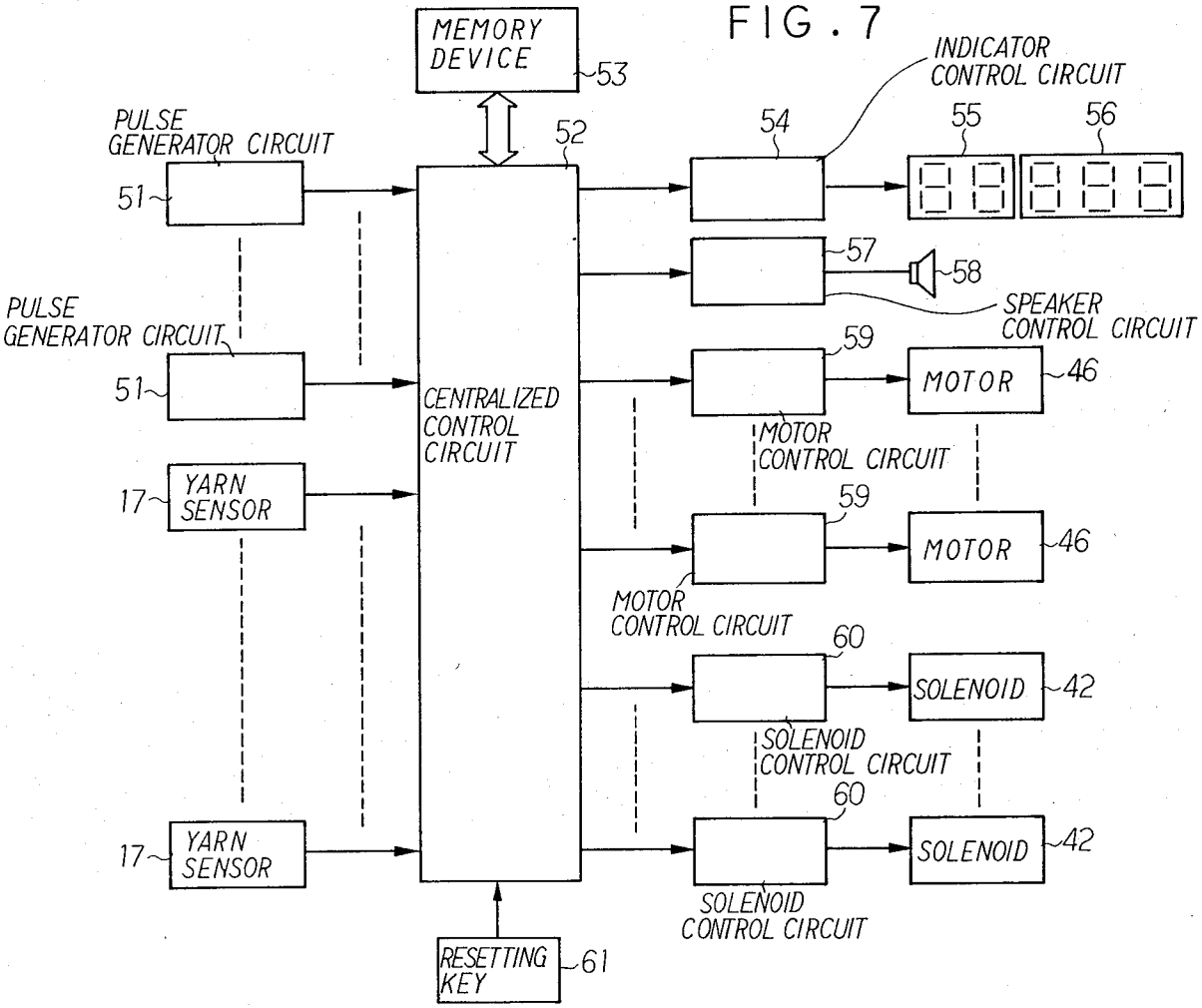
FIG. 7 is a schematic block diagram showing an embodiment of sliver can controlling apparatus of the invention.

A sliver can controlling apparatus for transporting a full sliver can 8*b* to a specified destination of an open-end spinning machine by computing the sliver consumption quanity at each of the spinning stations of each open-end spinning machine of the structure as described earlier and controlling the operation of the driving motors 46 for the respective lines of transporting tracks 19–26 and also of the solenoids 42 provided at the track junctions, will be now explained with reference to the block diagram presented in FIG. 7.

In FIG. 7, a pulse generator circuit 51, which is provided at each of the open-end spinning machines 1, is operatively connected to a driving shaft (not shown) of the winding drum 15 and arranged so as to generate a pulse signal for each turn or rotation of the driving shaft. Thus each pulse signal generated in synchronism with the rotation of the winding drum 15 corresponds to a given length of the yarn 14 wound up a package P by a single turn or rotation of said drum.

A control circuit 52 as a central processing unit provides signals for driving the chains 29 with the transporting hooks 30 for the respective transporting tracks 19–26, and computes the sliver consumption quantity at each of the respective spinning stations from the pulse signals supplied by the pulse generator circuit 51 and the detect signal by the yarn sensor 17 at each spinning station. That is, the control circuit 52 continues to count the turns or rotations of the winding drum 15 for each of the spinning stations through counting of said pulse signals during the normal spinning and winding operation at each spinning station, but stops its counting of the pulse signals for each spinning station when its yarn sensor 17 is energized to transmit a previously-mentioned detect signal to the control circuit 52 and while said detect signal is effective, e.g. while a yarn piecing or doffing operation is being performed and therefore no spun yarn is being wound. As is now apparent from the foregoing, the count of the pulse signals for each spinning station will represent the length or quantity of the yarn which is actually wound up on the bobbin B at that spinning station.

On the basis of such computed data of the yarn winding quantity, the control circuit 52 further computes the current sliver consumption quantity for each of the spinning station.

A memory device 53, which is operatively connected with the control circuit 52, includes memory regions each corresponding to each of the spinning stations of the machines 1 for storing the varying or progressively increasing quantity of sliver consumption at said each station. The memory device 53 has a reference value of preset data stored independently for comparison with the above variable data of sliver consumption quantities at the respective spinning stations, said reference value of preset data representing a magnitude of sliver consumption quantity at which the sliver can 8 becomes nearly empty and, accordingly, calls for replacement thereof with one full of a strand of new sliver. The control circuit 52 compares the variable data of sliver consumption quantities with the reference value of preset data, and when the sliver consumption at any one of the spinning stations is increased to such an extent that the reference value is reached thereby, the control circuit 52 supplies in response thereto an indicating signal utilized for indicating the numbers which designate the sliver can 8 whose remaining sliver 9 is thus about to be exhausted (or the spinning station having the sliver can 8 in question) and the spinning machine 1 which includes that spinning station, as well as a warning signal for providing production personnel with a warning to that effect.

An indicator control circuit 54 receives the indicating signal from the control circuit 52 and then operates on the subsequent spinning machine number and sliver can number indicators 55 and 56, respectively, to show the relevant numbers according to the signal. On the other hand, a spacker control circuit 57 receives the warning signal from the control circuit 52 and then energizes the subsequent speaker 58 as a warning means.

When the spinning station whose sliver can 8 is about to be emptied is located in this way by the control circuit 52 through comparison of the increasing sliver consumption quantity with the reference value of preset data in the memory device 53, said circuit computes to determine the appropriate supply track 23 and can takeout track 25 so that a full sliver can **8*b* then running on the distributing track 22 may be transported through said supply and takeout tracks to a position which is closest to the spinning station in question calling for replacement of its nearly empty can 8 with the full sliver can 8*b*, and then supplies to the appropriate motor and solenoid control circuits 59 and 60, respectively, the signals for initiating those motors 46 which move the transporting hooks 30 for the above supply and takeout tracks 23, 25 and the signals for energizing those solenoids 42 which actuate the releasing members 38 for allowing the full sliver can 8*b*** to reach the specified destination.

A resetting key 61 connected to the control circuit 52 is used when the empty sliver can is replaced with the full one **8*b* at the spinning station. By depressing this key 61, the data of sliver consumption quantity stored in the memory device 53** for that particular station is cleared or reset, thus permitting commencement of computation and storage of the sliver consumption quantity for the new sliver as soon as the spinning and winding operation is resumed with the new sliver.

The operation of the sliver can controlling apparatus thus constructed will be described in the following.

In normal operation of the spinning machines 1, a strand of spun yarn 14 withdrawn from the spinning unit 10 and passed over the yarn guide 11 is drawn by the draw-off roller 13 in conjunction with its paired pressure roller 12 and wound up on the bobbin B by the winding drum 15 into the yarn package P, as shown in FIG. 2, at each of the spinning stations of each spinning machine. During such normal spinning operation, pulse signals are generated cyclically by the pulse generator circuit 51 provided for each spinning machine 1, in synchronism with the rotation of the winding drum 15 and supplied as input signals to the control circuit 52. In the event of a yarn break or when a doffing operation is performed by a doffer (not shown) at any spinning station, the yarn sensor 17 corresponding to that spinning station is energized thereby to transmit a detect signal to the control circuit 52. On the other hand, empty sliver cans **8*a* are returned via the return tracks 19 to the drawing frames 18, where the cans are filled with a predetermined quantity of sliver 9, and the full sliver cans 8*b* thus prepared are delivered therefrom successively and circulated as required through the distributing track 22, second distributing track 24, storage track 26 and back to the first-mentioned track 22**.

As the yarn winding operation continues with occasional interruptions thereof due to yarn piecing or doffing, the control circuit 52 computes the current sliver consumption quantity at each of the spinning stations on the basis of the count of said pulse signals from the pulse generator circuit 51 of each spinning machine 1 and the detect signals from the yarn sensor 17 of each spinning station, and the computed data of such current sliver consumption quantity at said each spinning station is stored by the memory device 53. When the quantity is increased to reach the aforementioned reference value of preset data stored in the memory device 53 for comparison of the current sliver consumption quantity therewith; namely, when the sliver can 8 of the corresponding spinning station becomes nearly empty, the control circuit 52 transmits an indicator signal and a warning signal to the indicator control circuit 54 and speaker control circuit 57, respectively, for showing the location of the spinning station and its spinning machine on the indicators 55, 56 and simultaneously constituting a warning by means of the speaker 58.

Simultaneously, the control circuit 52 computes to determine the route through which a full sliver can **8*b* then running on the distributing track 22 may be carried to a position defined by the takeout track 25 which is closest to the spinning station then designated by the indicator 55, and then energizes the appropriate motors 46 and solenoids 42 to establish the computed route of transportation. For example, when the sliver can 8 at the first spinning station as counted from the gear end 2 on the left-hand side of the second spinning machine 1 as counted from the leftmost machine in FIG. 1 is going to be replaced with a full sliver can 8*b*, the control circuit 52 provides a control signal to energize the solenoid 42 disposed at the junction where the second supply track 23 as counted from the left branches off from the distributing track 22 and another signal for intitiating the motor 46 for moving the transporting hooks 30 in said second supply track. In addition, the control circuit 52 operates so as to energize the solenoid 42 at the junction where the first takeout track 25 as counted from the distributing track 22 branches off from said second supply track 23 and also to start the motor 46 for moving the hooks 30 in said first takeout track 25**.

In this way, the full sliver can 8*b* on the distributing track 22 is led to the second supply track 23 and then turned therefrom to the first takeout track 25, thus being brought up to the position adjacent to the spinning station in question. On the other hand, a workman who had been informed of the need of sliver can replacement at the spinning station designated by the indicators 55, 56 stands ready for the replacement. The empty can 8*a* removed from the spinning station is brought by him and placed on the return track 19 on the upper side, as viewed in FIG. 1, which is closer to the station. Since the return tracks 19 have transporting hooks 30 driven continually, the empty sliver can 8*a* may be transported back to the drawing frame 18 automatically for refilling of new sliver.

As it is now apparent from the foregoing description of a preferred embodiment, the apparatus according to the present invention permits automatic transportation of a full sliver can to a position adjacent to any spinning station as required, so that the workman only has to wait at the station for replacement of an empty can with the coming full sliver can. The production personnel in a spinning mill are relieved of the trouble of checking for the remaining sliver quantities at each of the spinning stations and then bringing as required a full sliver can all the way from a drawing frame or a sliver can storage station, with the result that labor in the spinning mill is saved and a much more efficient sliver can controlling system is realized for improvement in spinning productivity.

While the invention has been illustrated and described with reference to a preferred embodiment thereof, it is to be understood that various changes or modifications in the structure of the apparatus may be made without departing from the spirit and scope of the invention. For example:

(1) Though in the above-described embodiment a full sliver can 8*b* on the distributing track 22 is guided to the designated position by driving the transporting hooks 30 in the supply and takeout tracks 23 and 25, it may be so arranged that the supply tracks 23 are placed in a continual or intermittent operative state for admitting full sliver can 8*b* thereonto and that any one of the takeout tracks 25 is set in operation as required when a spinning station whose sliver is consumed to a predetermined extent is recognized by the control circuit 52. By so arranging, the full sliver can 8*b* may be introduced to the takeout track 25 directly from the supply track 23.

(2) The transporting hooks 30 disposed beneath each of the transporting tracks may be replaced by any other convenient means such as a conveyor, in which case a gate rotatable for changing the conveying direction may be provided at the junctions between tracks.

(3) The function of the control circuit 52 of computing the sliver consumption quantities at the respective spinning stations and of detecting those stations which have consumed a predetermined quantity of sliver may be performed by a sub-control circuit or device provided at each of the spinning machines, e.g., in the gear ends 2 thereof, wherein the central control circuit provided separately from the spinning machines transmits signals for controlling the operation of the respective transporting tracks in response to output signals from said sub-control circuit of each spinning machine.

(4) The pulse signals for counting the yarn winding quantity on the basis of which the sliver consumption quantity at each spinning station is computed may be generated in synchronism with the rotations of the driving shaft of the draw-off roller 13 in place of the winding drum 15.

(5) Instead of the yarn sensor 17 which is adapted specifically to detect a yarn break, a yarn sensor designed to detect the passage of a spun yarn may be provided at any point in the course of the yarn so that a signal similar to the aforementioned detect signal may be generated thereby in the event of a yarn break or during a doffing operation.

(6) In the spinning unit 10 which includes a clutch 63 between the feed roller 4 and its drive shaft 62 as shown in FIG. 2, wherein the clutch 63 is energized to stop the feed roller operation for interrupting sliver feeding during a yarn piecing or doffing operation, an electrical signal to energize said clutch may be utilized as the aforesaid detect signal which, in the preferred embodiment, is generated by the yarn sensor 17.

(7) The sliver consumption quantity may be computed in other ways than that described in connection with the preferred embodiment in the above, e.g. by counting the number of times the doffing operation is performed, or measuring the diameter of the yarn package P.

What is claimed is:

1. In a yarn spinning mill having a plurality of drawing frames for producing sliver, and a plurality of elongated spinning machines each having a plurality of spinning stations along its length, each said spinning station having means for spinning yarn from sliver drawn from a supply thereof within a removable sliver can adjacent to the station, the improvement comprising detecting means for detecting any one of said sliver cans adjacent to said spinning stations in which said sliver supply has been substantially exhausted by said yarn spinning at the spinning station, said detecting means comprising spun yarn length measuring means including yarn-breakage sensing means associated with each said spinning station and which together detect when said sliver supply adjacent to said station is substantially exhausted; sliver can delivery means operable responsive to said detecting means for delivering respective sliver cans, each containing said supply of sliver, from said drawing frames to adjacent any of said spinning stations at which said sliver supply is substantially exhausted, said sliver can delivery means comprising conveyor means including respective distributing tracks extending from said drawing frames, respective supply tracks branching from respective ones of said distributing tracks, each said supply track extending along the length of one of said spinning machines for conveying a sliver can to adjacent any one of its said spinning stations, sliver can transfer means at each branch point between any said distributing track and any said supply track branching therefrom, and a plurality of sliver can stop means on each said supply track for stopping a delivered sliver can substantially adjacent to any selected spinning stations therealong; and control means operable responsive to said detection by any of said spun yarn length measuring means for determining a route, and actuating said conveyor means along such route between said drawing frames and said spinning station associated with said yarn length measuring means to automatically deliver a sliver can to the spinning station.

2. The improvement according to claim 1, wherein said conveyor means further comprises respective takeout tracks branching from each of said supply tracks at spaced apart locations therealong, each said takeout track extending towards said spinning machine along the length of which said supply track extends, each of said plurality of sliver can stop means being adjacent to one of said takeout tracks for stopping a delivered sliver can thereat, and sliver can transfer means at each branch point between said supply track and any of said takeout tracks.

3. The improvement according to claim 1, which further comprises a control circuit, each said spun yarn length measuring means comprising means on said spinning machine with which said spinning station is associated for generating pulse signals synchronized with the rate of yarn spinning at said associated spinning station, each said yarn-breakage sensing means comprising a yarn sensor and means for generating a yarn breakage detection signal, said control circuit having means for receiving said pulse signals and said yarn breakage detection signal, computing actual yarn consumption therefrom, comparing said computing yarn consumption with a preset yarn consumption amount, and emitting an indicator signal for so actuating said conveyor means when said preset yarn consumption amount is attained.

4. The improvement according to claim 3, wherein each said spun yarn length measuring means comprises a yarn winding drum on said spinning station, and said means for generating pulse signals is synchronized with the rotation of said yarn winding drum.

5. The improvement according to claim 3, which further comprises warning signal means, and said control circuit further comprises means for energizing said warning signal means responsive to said attaining of said preset yarn consumption amount.

6. The improvement according to claim 3, which further comprises actuatable indicator means for each said spinning station, said control circuit further having means for selectively actuating said indicator means responsive to said attaining of said preset yarn consumption amount by each said spinning station, respectively.

* * * * *